US005515571A

United States Patent [19]

Grande

[11] Patent Number: 5,515,571

[45] Date of Patent: May 14, 1996

[54] JACK NOSE CLEANING TOOL FOR SOUND POWERED TELEPHONE EQUIPMENT

[75] Inventor: Frank A. Grande, Highland Beach, Fla.

[73] Assignee: Hose-McCann Telephone Co., Inc., Deerfield Beach, Fla.

[21] Appl. No.: 316,737

[22] Filed: Oct. 3, 1994

Related U.S. Application Data

[63] Continuation-in-part of Ser. No. 40,170, Mar. 30, 1993, abandoned.

[51] Int. Cl.[6] ..... A47L 25/00

[52] U.S. Cl. ..... 15/220.4; 15/210.1; 15/104.11

[58] Field of Search ..... 15/104.04, 104.93, 15/104.94, 160, 210.1, 220.4, 244.1, 104.011; 401/261, 265; 439/676

[56] References Cited

U.S. PATENT DOCUMENTS

| | | | |
|---|---|---|---|
| 1,710,127 | 4/1929 | Vaughn | 15/160 |
| 1,838,958 | 12/1931 | Page | 15/160 |
| 2,365,022 | 12/1944 | Sturtevant | 15/210 |
| 2,404,507 | 7/1946 | Link | 15/104.01 |
| 2,593,735 | 4/1952 | Delzell | 51/73 |
| 2,713,693 | 7/1955 | Johnson | 15/210.1 |
| 2,748,410 | 6/1956 | Chapman | 15/105 |
| 2,866,217 | 12/1958 | Dean | 15/220.4 |
| 2,877,484 | 3/1959 | Taylor et al. | 15/220.4 |
| 3,188,674 | 6/1965 | Hobbs | 15/179 |
| 4,263,692 | 4/1981 | Gremillion | 15/210 |
| 4,301,567 | 11/1981 | Tucker | 15/104.04 |
| 4,417,487 | 11/1983 | Stephens | 81/53.2 |
| 4,733,678 | 4/1988 | Bolois | 134/115 |
| 5,123,763 | 6/1992 | Simmons | 401/9 |

FOREIGN PATENT DOCUMENTS

| | | | |
|---|---|---|---|
| 0710077 | 6/1954 | United Kingdom | 15/220.4 |
| 1031561 | 6/1966 | United Kingdom | 15/104.04 |

*Primary Examiner*—David Scherbel
*Assistant Examiner*—Tony G. Soohoo
*Attorney, Agent, or Firm*—Weingram & Zall

[57] ABSTRACT

A cleaning tool for telephone jacks is provided which includes a hollow cylindrical body and a polishing wheel having an internal aperture mounted within the body. The jack nose of the telephone jack is cleaned in the aperture. The wheel is secured in the body by a washer and lock nut arrangement. Both the washer and the lock nut also have apertures therein which are mounted concentric with the aperture in the polishing wheel so that the jack nose can be passed through the wheel and through the aperture in the washer, and into the cavity in the lock nut so that the entire length of the nose can be cleaned in the wheel. The cavity provides space for the residual matter removed from the cleaning site to be deposited for retrieval at a later time. A handle attached to the locking nut manipulates the device.

16 Claims, 1 Drawing Sheet

JACK NOSE CLEANING TOOL FOR SOUND POWERED TELEPHONE EQUIPMENT

This is a continuation-in-part of application Ser. No. 08/040,170 filed on Mar. 30, 1993, now abandoned.

BACKGROUND OF THE INVENTION

1. Field of the Invention

The present invention relates to cleaning apparatus and more particularly, to tools for cleaning jacks of sound powered telephone communications equipment installed aboard naval and merchant vessels.

2. Description of the Prior Art

U.S. Pat. No. 2,365,022 to Sturtevant discloses a cleaning tool for soldering irons consisting of a tapered tube having disposed therein a cleansing cartridge typically of steel wool. The tip of the soldering iron is inserted into the tube and by rotation of the soldering iron, cleaning is effected.

U.S. Pat. No. 2,404,507 to Link discloses a wire brush of the type commonly employed for cleaning rust and foreign matter from metals, and is specifically for removing rust, corrosion and other foreign matter from cylinder head studs of automobile motors. The wire brush includes a hemispherical shaped plug having a shank connected thereto to which an electric drill is engaged. The shaped plug is threaded to a cylindrical shell with inwardly projecting bristles which is slipped over a stud bolt and rotated to remove foreign particles from the threads of the stud bolt.

U.S. Pat. No. 2,593,735 to Delzell discloses a cleaning device for maintaining switchboard terminal connector plugs used in telephone, telegraph and radio equipment free from damaging oxides, corrosion and dirt. The device is secured to the shaft of an electric motor and includes an inner body containing a plug tip polisher and an outer section containing a plug sleeve polisher, the two sections being connected by screw threads. Both polishers are made of compressible felt. In operation, the plug to be cleaned is pushed into the device so as to cause the outer end of the felt to polish. The felt may conveniently be dipped in a cleaning fluid or employed in conjunction with a powered polishing compound.

U.S. Pat. No. 2,748,410 to Chapman discloses a device for cleansing the grease fittings on motor vehicles. The device includes a cylindrical tubular element having a plurality of teeth or serrations at one end thereof. An internal washer is disposed within the tube together with a helical compression spring. In operation, the serrated end of the tube is pushed over the fitting and the tube oscillated so that the teeth loosen and remove dirt.

U.S. Pat. No. 3,188,674 to Hobbs discloses a rotary tube end cleaner comprising a hollow ridged cylindrical housing having a closed end and an open end and having the bristles of an elongated wire brush disposed in its interior. An axial shank is fixed to extend from the closed end for engagement in the chuck of an electric drill. In operation, the device is inserted over the end of the tube to be cleaned and then energized to rotate about the stationary tube to clean the tube.

U.S. Pat. No. 4,263,692 to Gremillion discloses a device for cleaning head phone receptacles. The device includes a cylindrical member having a central cylindrical cavity. The central cavity walls and the outer surface of the cylindrical member are bonded to a pliable material to which is bonded an abrasive surface. A spherical handle is attached to the distal end of the cylinder by a connecting shaft. In operation, the cylindrical member is inserted in a head phone receptacle and rotated to clean the floor and connecting post of the headphone receptacle.

U.S. Pat. No. 4,417,487 to Stephens discloses a tool for cleaning or changing contact tips. The device includes a cylindrically shaped handle having a cylindrical bore for receiving the contact tip. An aperture in the handle accommodates a rotatable member provided with teeth for engaging the side of the contact tip which is inserted in the cylindrical base.

U.S. Pat. No. 4,733,678 to Bolois discloses a device for cleaning an electrical jack having multiple contacts. The cleaning tools include a burnishing tool and an injector tool, the latter being used in conjunction with an aerosol can of spray solvent. The burnishing tool is in the shape of an electrical plug to be inserted in a jack and then twisted to clean the contacts. Following use of the burnishing tool, the injector tool is inserted in the jack and an aerosol spray is utilized for cleaning the contacts through an interior channel of the injector tool.

U.S. Pat. No. 5,123,763 to Simmons discloses a cleaning tool for removing debris and cleaning lug nuts for a wheel. The device includes a handle mounting shaft attached to a lug receiving socket which is lined with a fibrous covering.

There is, however, no disclosure in these patents of a device constructed to completely clean the nose portion and entire length of a telephone jack by employing a cavity of a particular size and shape to receive the telephone jack and provide a space where by-products of the cleaning process can be deposited away from the continued abrasion and cleaning of the jack and removed later on.

SUMMARY AND OBJECTS OF THE INVENTION

The current invention provides a cleaning tool for telephone jacks which are used in communication systems, specifically communication systems on board ship. Such jacks are characterized by an elongated metallic connecting male element which interfits within a corresponding connecting female member.

These jacks are sensitive to dirt, and especially corrosion resulting from exposure to the salt water environment. The effect of such impurities on the jack is disruptive to the communication system. The invention includes a rigid abrasive polishing member having an internal aperture of a diameter to receive the full length of the telephone jack. The abrasive polishing wheel is mounted in a housing body portion. The wheel is confined into position in the housing with a stuffing nut and a flat washer. A handle may be attached to the stuffing nut to manipulate the device. Both the washer and the stuffing nut are also apertured so as to receive a portion of the telephone jack so that the entire length of the jack can be brought into engagement with the interior polishing surfaces of the polishing wheel.

Specifically, the present invention includes a cavity which is configured to permit reciprocating movement of the nose portion and entire length of the telephone jack for cleaning against an abrasive member and to provide a space for any residual matter cleaned from the jack so that the matter can be removed after the cleaning operation and will not interfere with the continued cleaning of the telephone jacks.

The present invention provides a device which is easily used to clean the jacks because the device can be manipulated by rotation to clean the jack by the abrasive action of the wheel.

The principal object of the present invention is to provide a cleaning tool which has a cavity portion of a construction to receive the telephone jack so that the shavings and/or particulate matter which is abraded from the jack during the cleaning operation can be deposited so as not to interfere with the cleaning operation and be removed later on.

Another object of the invention is the provision of a cleaning tool which does not require any additional devices or any special manipulation to clean the telephone jacks.

Another object of the present invention is the provision of a jack cleaning tool having an abrasive polishing wheel which surrounds the entire diameter of the surface of the jack.

Still a further object and advantage of the present invention is the provision of a jack cleaning tool where the abrasive cleaning surface can be applied to the jack without the necessity of the user touching or otherwise coming into contact with any portion of the abrasive or cleaning element.

Still a further object and advantage of the present invention is the provision of a tool which can be easily assembled and disassembled so as to provide fresh, abrasive surfaces and to keep the tool itself clean and ready for use without risk of repeated use of the tool itself contaminating the jack.

Still a further object and advantage of the present invention is the provision of a jack cleaning tool employing a polishing wheel having an internal diameter which provides a rigid, abrasive cleaning surface. The polishing wheel is held in place by a washer and a stuffing nut. The stuffing nut can be removed from the body of the tool to access the cleaning cavity for removal of debris and to free the washer and the polishing wheel for cleaning and/or replacement.

BRIEF DESCRIPTION OF THE DRAWINGS

These as well as further objects and advantages of the present invention will become apparent to those skilled in the art upon review of the following detailed description, reference being made to the accompanying drawings in which.

DETAILED DESCRIPTION OF THE PREFERRED EMBODIMENT

Figure 1:
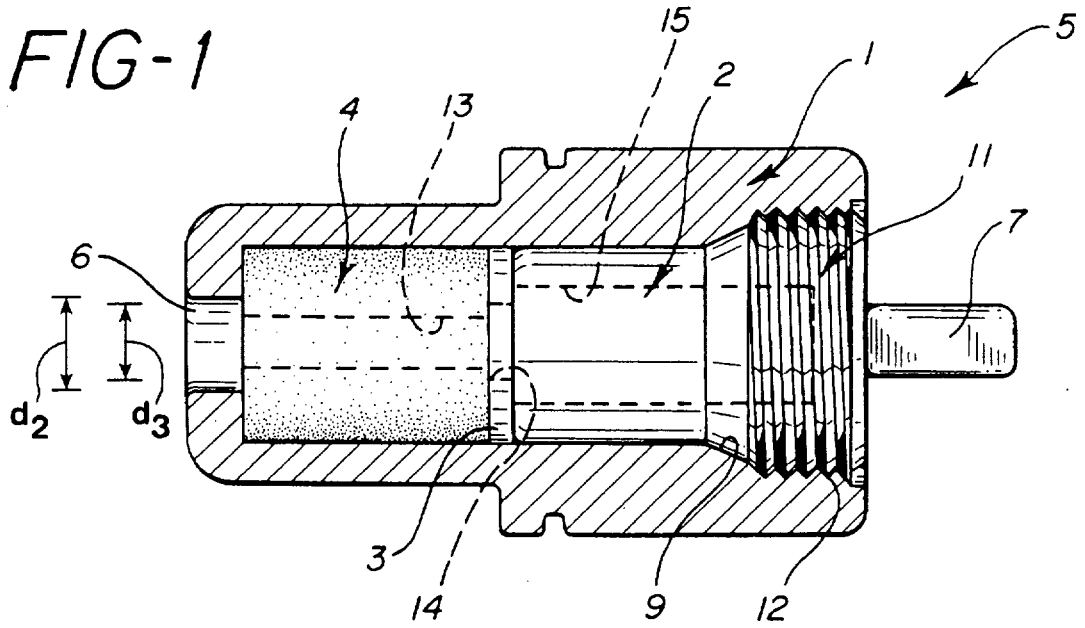
FIG. 1 is a cross-sectional view of the jack nose cleaning tool of the present invention.

With reference being made to the accompanying drawings in which like reference numbers designate like parts, the jack nose cleaning tool of the present invention is found generally at 5. The tool includes a body portion 1, which is hollow. Mounted within the body portion 1 is the polishing wheel 4, which resembles a cylindrical structure, a washer 3, and a stuffing nut 2. The polishing wheel 4 sits in a portion of the body 1 adjacent to an aperture 6 formed at one end of the body 1. The aperture 6 is of sufficient diameter so as to receive the jack portion (not shown) of a telephone device (not shown).

The polishing wheel 4 is secured in place by washer 3 and the stuffing nut 2 which resembles a plug. The stuffing nut 2 has a threaded end portion 11 which threadably engages an internal threaded portion correspondingly formed in the internal diameter of body 1. Attached to and integral with the stuffing nut is a handle 7 which is provided to manipulate the device.

To disassemble the device, the stuffing nut 2 is threadably disengaged from the body portion i thereby freeing the washer 3 for removal and thereby permitting the polishing wheel 4 to be removed from its location, as shown in FIG. 1, out of the body portion via the space vacated by removal of the stuffing nut 2.

As also shown in FIG. 1, the internal diameter of the body 1 is constant except for an increasing diameter portion 9 and a larger diameter portion 12 which is threaded to receive threads 11 of the stuffing nut 2.

It is also to be noted that polishing wheel 4 has an internal aperture 13 formed therethrough which is coaxial with internal aperture 14, washer 3 and internal cavity 15 or aperture in the stuffing nut 2.

The concentricity of these internal apertures enables the entire length of the jack shaft to be taken up into and through the polishing surface formed by aperture 13 in the polishing wheel 4 and thereby the length of the jack is taken up into the internal portion 15 of the stuffing nut 2.

Figure 2:
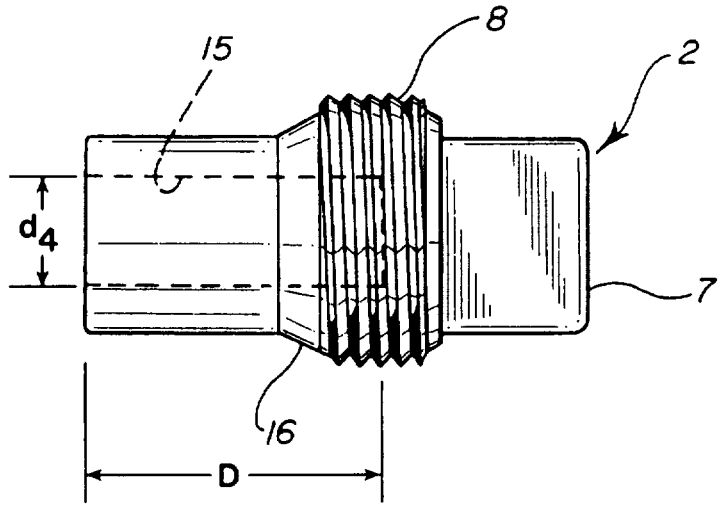
FIG. 2 is a side view of a retaining assembly of the present invention.

FIG. 2 is a side view of the stuffing nut 2 of FIG. 1. Stuffing nut 2 has threaded portion 8, and an internal cavity 15 formed therein. The diameter of the stuffing nut is reduced at section 16 from a large outer diameter at the threaded end 8 to a smaller diameter portion. Handle 7 may be attached to or formed integrally with the stuffing nut. FIG. 2 shows the side view of the handle 7, while FIG. 1 shows the edge of the handle.

Figure 3:
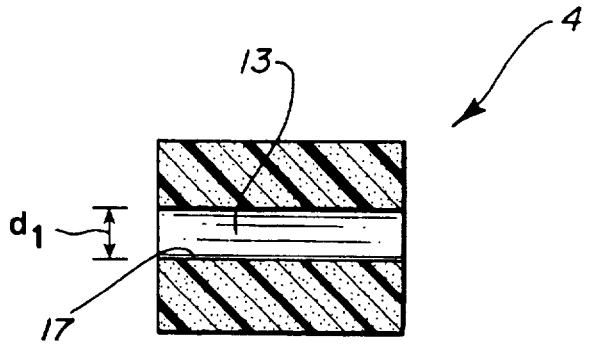
FIG. 3 is a cross-sectional view of the abrasion member of the present invention.

FIG. 3 is a side view of the polishing wheel 4 used in the invention. The polishing wheel 4 is an abrasive wheel of rigid material 4 having an internal bore 13 formed to extend throughout the entire length of the wheel. The inner surface of the cylindrical bore 13 includes an abrasive surface 17 which is utilized to clean the telephone jack nose and the entire length of the jack.

In a preferred embodiment of the present invention, the internal bore 13 of the polishing wheel 4 is of a diameter $d_1$ less than the diameter $d_2$ of the aperture 6 of the body portion 1. The internal bore 14 of the washer 3 has a diameter $d_3$ greater than the diameter $d_1$ of the internal bore 13 of the polishing wheel 4. The cavity 15 of the stuffing 2 is provided with a diameter $d_4$ larger than that of the aperture 6 and the internal bores 13, 14. The cavity is constructed and arranged to have a depth D greater than the length of the nose portion of a telephone jack intended to be cleaned to permit reciprocating movement of the nose portion and the entire length of the telephone jack along the abrasive surface 17 at the internal bore 13 of the polished wheel 4. This extra length in the cavity 15 provides space for any residual matter cleaned from the jack to fall and be deposited therein. The advantages of this extra space are at least twofold. First, during the abrasive cleaning operation, as the jack nose and length of the jack are moved along the abrasive surface 17 into the cavity 15, debris and particulate matter abraded from the surface of the jack are deposited in the cavity 15 so as not to interfere with the continued reciprocating motion of the jack across the abrasive surface 17. Secondly, when the stuffing nut 2 is threadably disengaged from the body portion 1, the cavity 15 provides a space for a deposit of shavings and particulate matter which can be removed from the tool for disposal.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

What is claimed is:

1. A cleaning device for a communications jack, the cleaning device comprising:

a body portion comprising:

an outer surface, a first circular opening, a second circular opening, a central bore extending through the body portion between the first and second circular openings, a generally cylindrical central surface extending along the central bore, the central surface formed with a threaded portion at the second circular opening, a gripping surface along the exterior surface of the body portion to manipulate the body portion for cleaning a communications jack;

cleaning means disposed in the central bore of the body portion, the cleaning means comprising:

an abrading material, a first internal circular bore extending through said abrading material in communication with the first circular opening of the body portion and having a diameter less than the diameter of the first circular opening;

confining means disposed in the central bore of the body portion to confine the cleaning means with respect to the first circular opening of the body portion, the confining means comprising:

a second internal circular bore extending through said confining means in communication with the first internal circular bore of the cleaning means and having a diameter greater than the diameter of the first internal circular bore of the cleaning means; and a retaining member comprising:

a cylindrical section formed with an exterior surface, a threaded section along a portion of the exterior surface of the cylindrical section, the threaded section adapted to operatively engage the threaded portion at the second circular opening of the central bore, said exterior surface of the cylindrical section being slidably engaged with said central surface, a tubular cavity formed in the cylindrical section, the tubular cavity in communication with the second internal circular bore of the confining means and having a diameter larger than the first internal circular bore of the cleaning means to permit reciprocal and rotational movement of a communications jack to be cleaned, wherein the tubular cavity is of a predetermined length to provide space about an end portion of a communications jack for residual matter cleaned therefrom to be deposited, and a handle connected to the cylindrical section of the retaining member to facilitate the threading of the retaining member in order to force the cylindrical section against the confining means to fix the cleaning means in position in the central bore of the body portion.

2. The cleaning device according to claim 1, wherein a depth of the tubular cavity exceeds a length of the first internal circular bore of the cleaning means.

3. The cleaning device according to claim 1, wherein the abrading material includes a polishing surface.

4. The cleaning device according to claim 1, wherein the first circular opening, the first and second internal circular bores and the tubular cavity are coaxial.

5. The cleaning device according to claim 1, wherein the retaining means is a plug-like member.

6. The cleaning device according to claim 1, wherein the confining means is a washer.

7. A cleaning device for a communications jack, the cleaning device comprising:

a body portion having a cylindrical aperture formed at one end thereof;

a cleaning member for cleaning a communications jack, the cleaning member mounted in said body portion adjacent to said cylindrical aperture and having a first cylindrical bore formed therethrough, said first cylindrical bore in communication with said cylindrical aperture of said body portion;

a securing member for securing said cleaning member in said body portion, said securing member mounted in said body portion and having a second bore formed therethrough in communication with said first cylindrical bore of said cleaning member; and a retaining member comprising:

an outer surface constructed with a threaded portion thereon to threadably engage said body portion for retaining said securing member to fix said cleaning member in said body portion adjacent to said cylindrical aperture, a cylindrical cavity formed in said retaining member in communication with said second bore of said securing member, said cylindrical cavity aligned with said first and second bores to provide a length greater than a length of a communications jack to be cleaned, said cylindrical cavity aligned with said first and second bores to permit reciprocal and rotational movement of a communications jack and to provide space in said cylindrical cavity about an end portion of a communications jack for residual matter cleaned therefrom to be deposited.

8. The cleaning device according to claim 7, wherein said cleaning member comprises:

a cylindrical structure, and an abrasive-polishing surface along said first cylindrical bore of said cleaning member.

9. The cleaning device according to claim 7, wherein said retaining member is removably mounted to said body portion for providing access to said cleaning member and said securing member.

10. The cleaning device according to claim 9, wherein said retaining member comprises:

a plug constructed with said threaded portion along said outer surface thereof for threaded engagement with a correspondingly threaded portion of said body portion.

11. The cleaning device according to claim 10, wherein said outer surface of said plug has a slidable portion for slidably engaging an interior of said body portion.

12. The cleaning device according to claim 7, wherein said aperture, first and second bores, and said cavity are coaxial.

13. The cleaning device according to claim 7, wherein said securing member is a washer.

14. The cleaning device according to claim 7, wherein said retaining member is disposed in said body portion.

15. The cleaning device according to claim 7, wherein a diameter of said cavity is greater than a diameter of said first cylindrical bore of said cleaning member and said aperture of said body portion.

16. The clearing device according to claim 7, wherein said retaining member is releasably engaged to said body portion for removal therefrom to permit access to and replacement of said cleaning member and said securing member.

* * * * *